US008534185B2

(12) United States Patent
Riley et al.

(10) Patent No.: US 8,534,185 B2
(45) Date of Patent: Sep. 17, 2013

(54) RECIPROCATING PUMP HAVING A PRESSURE COMPENSATED PISTON

(75) Inventors: Andrew Dale Riley, Eufaula, OK (US); Jason Whaley, Houston, TX (US)

(73) Assignee: National Oilwell Varco, L.P., Houston, TX (US)

( * ) Notice: Subject to any disclaimer, the term of this patent is extended or adjusted under 35 U.S.C. 154(b) by 889 days.

(21) Appl. No.: 12/596,903

(22) PCT Filed: Apr. 23, 2008

(86) PCT No.: PCT/US2008/061312

§ 371 (c)(1), (2), (4) Date: Feb. 12, 2010

(87) PCT Pub. No.: WO2008/131429

PCT Pub. Date: Oct. 30, 2008

(65) Prior Publication Data

US 2011/0168014 A1 Jul. 14, 2011

Related U.S. Application Data

(60) Provisional application No. 60/913,411, filed on Apr. 23, 2007.

(51) Int. Cl.
*F04B 39/10* (2006.01)

(52) U.S. Cl.
USPC ..... 92/185; 92/112

(58) Field of Classification Search
USPC ..... 92/110, 112, 182, 184, 185, 250
See application file for complete search history.

(56) References Cited

U.S. PATENT DOCUMENTS

| | | | | | |
|---|---|---|---|---|---|
| 896,947 | A | * | 8/1908 | Stallman | 92/182 |
| 1,508,264 | A | * | 9/1924 | Armentrout | 92/182 |
| 1,604,287 | A | * | 10/1926 | Kibele | 92/185 |
| 1,612,038 | A | * | 12/1926 | Miller | 92/183 |
| 1,773,363 | A | * | 8/1930 | Kibele | 92/185 |
| 1,777,219 | A | * | 9/1930 | Murray | 92/184 |
| 2,224,916 | A | * | 12/1940 | McFarlane | 92/182 |
| 2,268,544 | A | * | 1/1942 | Coberly | 92/112 |
| 2,295,160 | A | * | 9/1942 | Christenson | 92/112 |
| 3,329,068 | A | * | 7/1967 | Klaus | 92/112 |
| 4,023,469 | A | * | 5/1977 | Miller | 92/112 |
| 7,124,819 | B2 | | 10/2006 | Ciglenee et al. | |
| 2005/0249613 | A1 | | 11/2005 | Jordan et al. | |

OTHER PUBLICATIONS

PCT International Search Report and Written Opinion for appl. No. PCT/US2008/061312 dated Sep. 9, 2008; (7 p.).
Office Action Dated Apr. 19, 2011 from Chinese Patent Office for Chinese Patent Application No. 200880013515.8.

* cited by examiner

*Primary Examiner* — Thomas E Lazo
(74) *Attorney, Agent, or Firm* — Conley Rose, P.C.

(57) ABSTRACT

A pump including a pressure compensated piston is disclosed. In some embodiments, the pump includes a piston with an annular body and an annular sealing element disposed radially outward of the annular body. The annular body has a radially-facing outer surface adjacent an inner surface of the sealing element and an axially-facing surface with an inlet port. A flowpath extends between the inlet port and the radially-facing outer surface of the annular body.

21 Claims, 3 Drawing Sheets

RECIPROCATING PUMP HAVING A PRESSURE COMPENSATED PISTON

STATEMENT REGARDING FEDERALLY SPONSORED RESEARCH OR DEVELOPMENT

Not applicable.

BACKGROUND

1. Field of Art

The disclosure relates generally to pumps, particularly reciprocating pumps, such as mud pumps used in the recovery of oil and gas. More particularly, the disclosure relates to piston components for creating and maintaining a seal between the piston and a surrounding pump cylinder.

2. Background of Related Art

Mud pumps are commonly used for conveying drilling mud during well drilling operations, such as for the recovery of oil and gas. Because of the need to pump the drilling mud through several thousand feet of drill pipe, such pumps typically operate at high pressures. Also, it is necessary for the drilling mud to emerge from the drill bit at a high flow rate in order to provide lubrication and cooling to the bit and to provide a vehicle for removal of drill cuttings from the earth formation being drilled. Further, the pressure generated by the mud pump contributes to the total downhole pressure, which is important and provided to prevent well blowouts.

Conventional mud pumps generally require interference between the sealing element of the piston and the surrounding cylinder to assure a seal between the two components and to provide sufficient material to maintain the seal while allowing for wear over the effective service life of the piston. This interference, however, results in a frictional load on the piston, which reduces pump efficiency. Moreover, the combined effect of the frictional forces resulting from the reciprocating contact between the piston seal and the cylinder, and the abrasive nature of drilling mud passing through the pump at high pressure is especially harmful to the sealing element. As the piston moves, edges of the sealing element experience wear and may become damaged. In some instances, the frictional force may be sufficient to cause the sealing element to detach from the piston.

Accordingly, means for maintaining a seal between a pump piston and a surrounding cylinder that also minimize wear to the piston components and frictional loads between the piston and cylinder are desirable.

SUMMARY OF SOME OF THE DISCLOSED EMBODIMENTS

A reciprocating pump having a pressure compensated piston is disclosed. In some embodiments, the piston includes an annular body having a radially-facing outer surface and an annular sealing element disposed radially outward of the annular body. The sealing element has an inner surface adjacent the radially-facing outer surface of the body. The annular body further includes an axially-facing surface with an inlet port and a flowpath extending between the inlet port and the radially-facing outer surface.

In some embodiments, the pump includes a rod having a cavity and a piston disposed about the rod. The piston includes an annular body having a radially-facing outer surface and an annular sealing element disposed about the annular body. The sealing element has an inner surface adjacent the radially-facing outer surface. A first fluid path extends between an end of the rod and the cavity, while a second fluid path extends between the cavity and the radially-facing outer surface. A resilient pressure transfer element disposed in the cavity and separating the first and the second flow paths.

Thus, embodiments described herein comprise a combination of features intended to enable enhancement of certain prior pumps and pump components. The various features and characteristics described above, as well as others, will be readily apparent to those skilled in the art upon reading the following detailed description of the preferred embodiments, and by referring to the accompanying drawings.

BRIEF DESCRIPTION OF THE DRAWINGS

For a detailed description of the disclosed embodiments, reference will now be made to the accompanying drawings in which.

DETAILED DESCRIPTION OF THE DISCLOSED EMBODIMENTS

Figure 1:
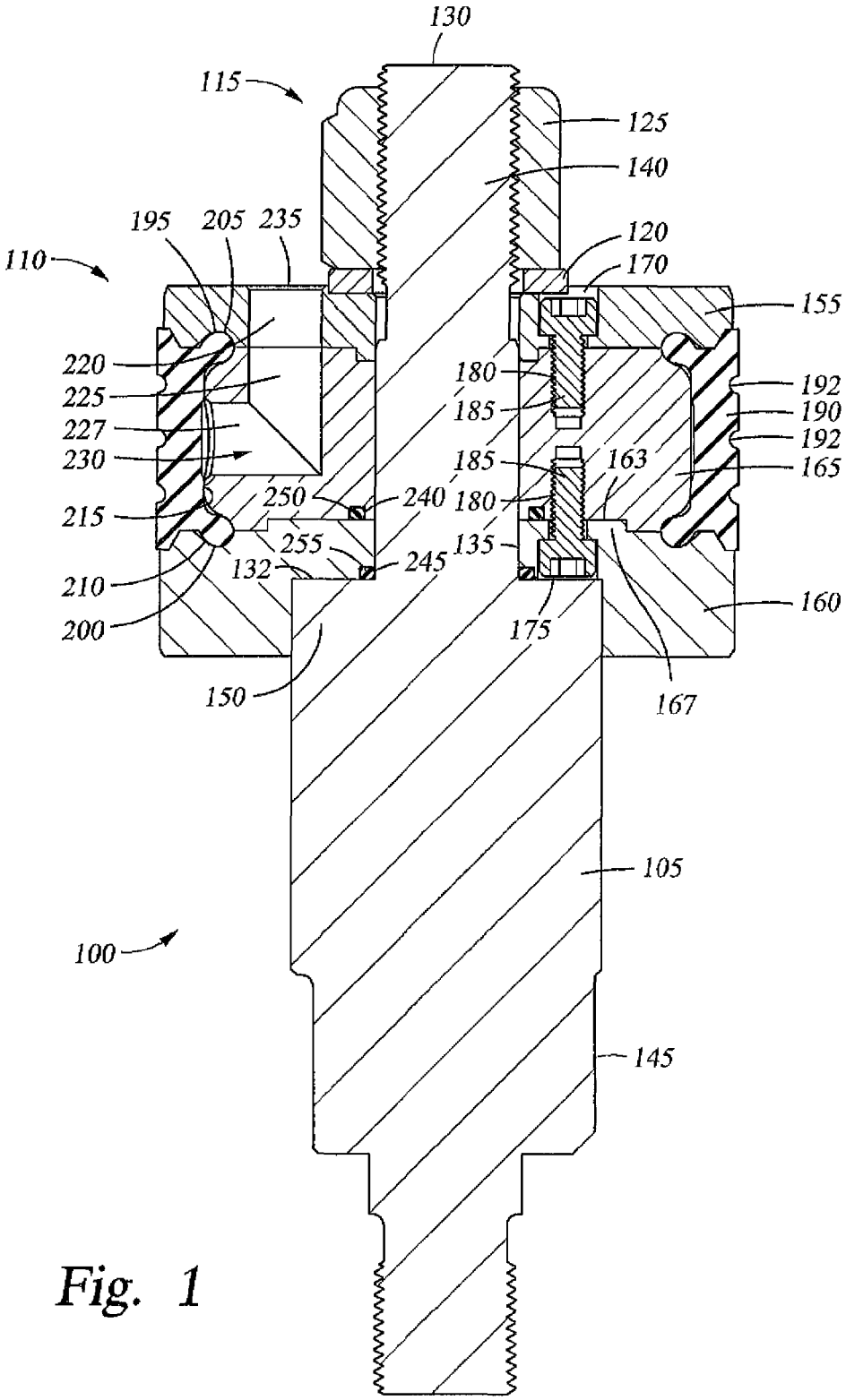
FIG. 1 is a cross-sectional view of a piston rod assembly including a pressure compensated piston made in accordance with the principles described herein.

The following discussion is directed to various exemplary embodiments of the invention. The embodiments disclosed should not be interpreted, or otherwise used, as limiting the scope of the disclosure, including the claims. In addition, one skilled in the art will understand that the following description has broad application, and the discussion of any embodiment is meant only to be exemplary of that embodiment, and not intended to suggest that the scope of the disclosure, including the claims, is limited to that embodiment.

Certain terms are used throughout the following description and claims to refer to particular features or components. As one skilled in the art will appreciate, different persons may refer to the same feature or component by different names. This document does not intend to distinguish between components or features that differ in name but not function or structure. The drawing figures are not necessarily to scale. Certain features and components herein may be shown exaggerated in scale or in somewhat schematic form, and some details of conventional elements may not be shown in interest of clarity and conciseness.

In the following discussion and in the claims, the terms "including" and "comprising" are used in an open-ended fashion, and thus are to be interpreted to mean "including, but not limited to." Also, the term "couple" or "couples" is intended to mean either an indirect or direct connection. Thus, if a first device couples to a second device, that connection may be through a direct connection, or through an indirect connection via other devices and connections. Further, the terms "axial" and "axially" generally mean along or parallel to a central or longitudinal axis, while the terms "radial" and "radially" generally mean perpendicular to a central longitudinal axis.

Referring now to FIG. 1, piston rod assembly 100 includes a rod 105 disposed within a pressure compensated piston 110. A retainer 115 couples piston 110 to rod 105. In this embodiment, retainer 115 includes a washer 120 and a nut 125 threaded onto an end 130 of rod 105. Pressure compensated piston 110 is annular, and includes an axial throughbore 135 and a circular recess 132, both configured to receive rod 105, as shown. Rod 105 includes an elongate extension 140 connected to a base portion 145. Extension 140 of rod 105 is inserted through axial throughbore 135 of piston 110. Base portion 145 of rod 105 has a diameter greater than that of extension 140 and thereby forms a shoulder 150. Circular recess 132 of piston 110 receives shoulder 150 of rod 105 such that piston 110 is seated against rod 105.

Piston 110 further includes a front cover 155, a rear cover 160 and a body 165 disposed therebetween, all of which are annular. Body 165 includes a circular recess 163 that receives a circular projection 167 of rear cover 160. When rear cover 160, front cover 155 and body 165 are assembled together or constructed as shown, these components form axial throughbore 135, which receives rod 105. Front cover 155 and rear cover 160 each include one or more throughbores 170, 175, respectively. Piston body 165 includes one or more screwholes 180 which align with throughbores 170, 175 when body 165 is disposed between front and rear covers 155, 160, as shown. To secure these components together, and thus form piston 110, a screw 185 is inserted through each throughbore 170, 175 of front and rear covers 155, 160, respectively, and threaded into an aligned screwbore 180 in body 165. Front cover 155, rear cover 160 and body 165 are preferably made of metal, and in some embodiments, are made of stainless steel.

Piston 110 further includes an annular sealing member 190 disposed radially outward and adjacent to body 165. Sealing member 190 includes a generally cylindrical inner surface 215, a generally cylindrical outer surface 217, and two irregular end surfaces 195, 200. Outer surface 217 includes one or more seal grooves 192. Irregular end surface 195 includes an annular recess and an annular extending lip. Front cover 155 includes an inner mating surface 205 that includes an annular extending lip and an annular recess that are shaped to receive the annular recess and the annular extending lip, respectively, thus allowing irregular end surface 195 of sealing element 190 to interlock with inner mating surface 205 of front cover 155. Similarly, irregular end surface 200 includes an annular recess and an annular extending lip. Rear cover 160 includes an inner mating surface 210 that includes an annular extending lip and an annular recess that are shaped to receive the annular recess and the annular extending lip, respectively, thus allowing irregular end surface 200 of sealing element 190 to interlock with inner mating surface 210 of rear cover 160.

Once sealing element 190 is sandwiched between front and rear covers 155, 160 about body 165, as shown, the shape of irregular surfaces 195, 200 and their respective mating surfaces 205, 210 on front and rear covers 155, 160 hold sealing element 190 in position and prevent translational movement of sealing member 190 relative to the other components of piston 110. Sealing member 190 is not, however, connected in any other way to the adjacent components of piston 110. As will be described, sealing member 190 is instead free to expand in the radially outward direction when a pressure load is applied along its inner surface 215, and to subsequently contract or relax when the pressure load is removed. To enable such expansion and contraction, sealing member 190 is preferably made of a resilient material, such as an elastomer, and in some embodiments, is made of polyurethane.

Front cover 155 further includes a series of axial flowbores 220, each spaced circumferentially about piston rod assembly 100. Body 165 further includes a series of radial flowbores 227, each flowbore 227 coupled to an axial flowbore 225, also spaced circumferentially about piston rod assembly 100. When piston 110 is assembled as shown, an axial flowbore 220 of front cover 155 aligns with an axial flowbore 225 of body 165 to form an "L-shaped" flowpath 230 extending from an inlet 235 in front cover 155 to inner surface 215 of sealing element 190.

Body 165 further includes an annular groove 240 along its inner surface adjacent rod 105. Similarly, rear cover 160 further includes an annular groove 245 along its inner surface adjacent rod 105. Grooves 240, 245 are configured to receive annular sealing elements 250, 255, respectively. In some embodiments, including those illustrated by FIG. 1, sealing elements 250, 255 are O-rings. Sealing elements 250, 255 prevent loss of fluid from flowbores 220, 225 other than through inlet 235.

As will be described, piston rod assembly 100 may be installed within a reciprocating pump and used to pressurize fluid, such as drilling mud. During operation of the pump, the fluid, referred to henceforth as drilling fluid, enters inlet 235 of front cover 155 and flows along flowpath 230 through flowbore 220 of front cover 155 and flowbores 225, 227 of body 230 until reaching sealing element 190, where the drilling fluid applies a pressure load to inner surface 215 of sealing element 190. In response to the applied pressure load, sealing element 190 expands in the radially outward direction. Moreover, the higher the pressure of the drilling fluid, the greater the pressure load to sealing element 190 and the more sealing element 190 expands radially outward.

Conversely, when the drilling fluid exits flowbores 220, 225, 227 through inlet 235 or when the pressure of the drilling fluid contained within flowbores 220, 225, 227 decreases, the pressure load applied to inner surface 215 of sealing element 190 also decreases. In response to the pressure load reduction, sealing element 190 relaxes or contracts. In the absence of drilling fluid pressure, sealing element 190 relaxes to its unexpanded configuration, as shown in FIG. 1.

Figure 2:
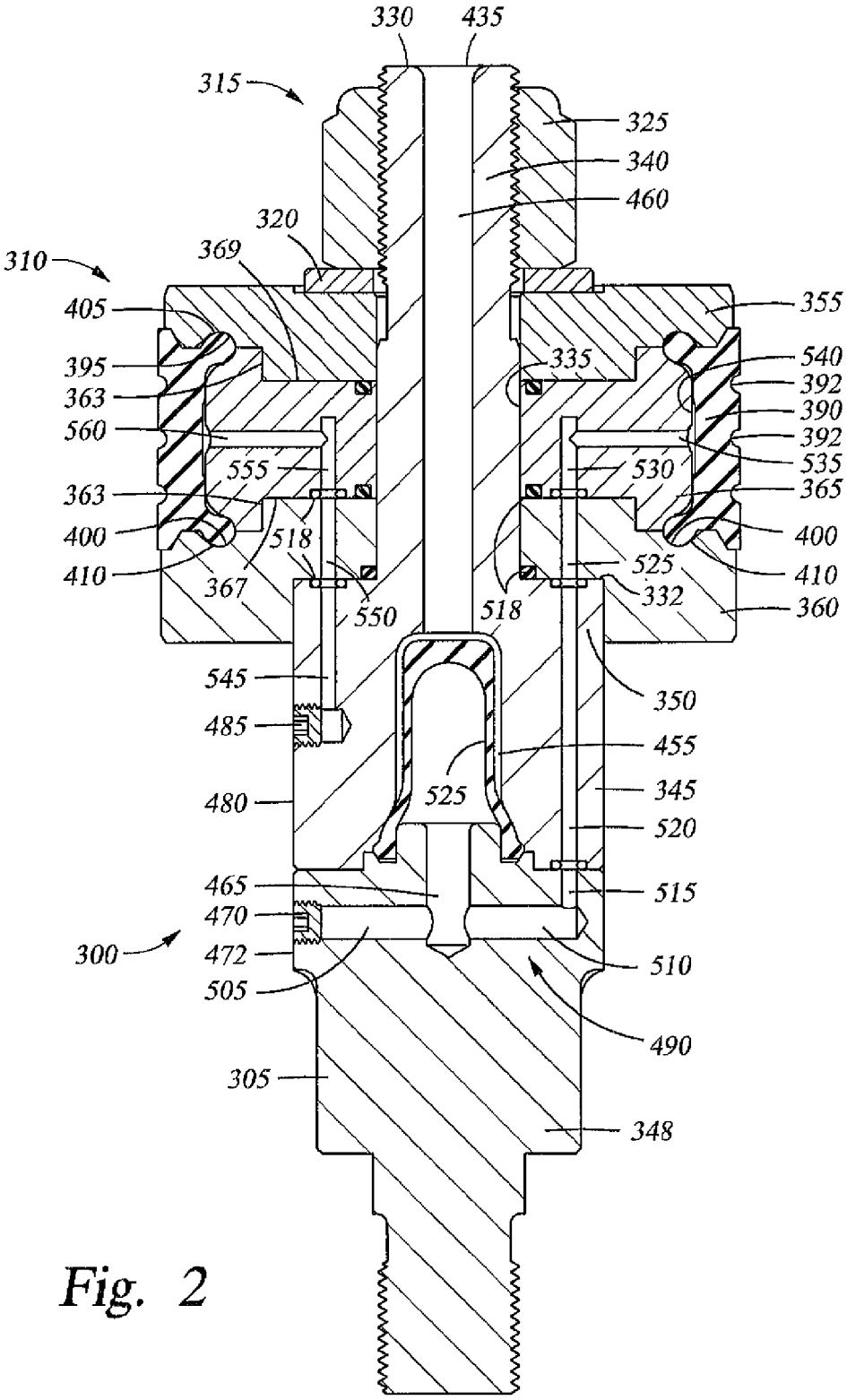
FIG. 2 is a cross-sectional view of another pressure compensated piston rod assembly made in accordance with the principles described herein.

Some drilling fluids, such as mud, which may be pressurized by a pump including a pressure compensated piston, contain abrasive particles that may damage the sealing element of the piston, or be otherwise incompatible with the piston, and cause excessive wear and ultimately loss of the seal between the piston and surrounding cylinder. In such circumstances, it may be desirable to include a barrier within the piston rod assembly to prevent exposure of the sealing element to the abrasive drilling fluid. FIG. 2 depicts a pressure compensated piston rod assembly that includes such a barrier.

Referring now to FIG. 2, piston rod assembly 300 includes a rod 305 disposed within a pressure compensated piston 310. A retainer 315 couples piston 310 to rod 305. In this embodiment, retainer 315 includes a washer 320 and a nut 325 threaded onto an end 330 of rod 305. Pressure compensated piston 310 is annular, and includes an axial throughbore 335 and a circular recess 332, both configured to receive rod 305, as shown. Rod 305 includes a first base portion 348 coupled to a second base portion 345 having an elongate extension 340. Extension 340 of rod 305 is inserted through axial throughbore 335 of piston 310. Second base portion 345 of rod 305 has a diameter greater than that of extension 340 and thereby forms a shoulder 350. Circular recess 332 of piston 310 receives shoulder 350 of rod 305 such that piston 310 is seated against rod 305.

Piston 310 further includes a front cover 355, a rear cover 360 and a body 365 disposed therebetween, all of which are annular. Body 365 includes circular recesses 363 that receive circular projections 367, 369 of rear cover 360 and front cover 355, respectively. When front cover 355, rear cover 360 and body 365 are assembled or constructed as shown, these components form axial therethrough 335, which receives extension 340 of rod 305. Front cover 355, rear cover 360 and body 365 are preferably made of metal, and in some embodiments, are made of stainless steel.

Piston 310 further includes an annular sealing member 390 disposed radially outward and adjacent to body 365. Sealing member 390 includes a generally cylindrical inner surface 415, a generally cylindrical outer surface 417, and two irregular end surfaces 395, 400. Outer surface 417 includes one or more seal grooves 392. Irregular end surface 395 includes an annular recess and an annular extending lip. Front cover 355 includes an inner mating surface 405 that includes an annular extending lip and an annular recess that are shaped to receive the annular recess and the annular extending lip, respectively, thus allowing irregular end surface 395 of sealing element 390 to interlock with inner mating surface 405 of front cover 355. Similarly, irregular end surface 400 includes an annular recess and an annular extending lip. Rear cover 360 includes an inner mating surface 410 that includes an annular extending lip and an annular recess that are shaped to receive the annular recess and the annular extending lip, respectively, thus allowing irregular end surface 400 of sealing element 390 to interlock with inner mating surface 410 of rear cover 360.

Once sealing element 390 is sandwiched between front and rear covers 355, 360 about body 365, as shown, the shape of irregular surfaces 395, 400 and their respective mating surfaces 405, 410 on front and rear covers 355, 360 hold sealing element 390 in position and prevent translational movement of sealing member 390 relative to the other components of piston 310. Sealing member 390 is not, however, connected in any other way to the adjacent components of piston 310. As will be described, sealing member 390 is instead free to expand in the radially outward direction when a pressure load is applied along its inner surface 415, and to subsequently contract or relax when the pressure load is removed. To enable such expansion and contraction, sealing member 390 is preferably made of a resilient material, such as an elastomer, and in some embodiments, is made of polyurethane.

Rod 305 further includes a cavity 455 therein and an axial flowbore 460 coupled thereto. Axial flowbore 460 extends from cavity 455 through end 330 of rod 305, terminating at an inlet 435. As will be described, drilling fluid enters rod 305 through inlet 435 and flows through flowbore 460 into cavity 455.

A hydraulic system 490 is also coupled to cavity 455 and extends initially from cavity 455 in the opposite direction as that of axial flowbore 460. Hydraulic system 490 includes an axial flowbore 465, which extends from cavity 455 through first base portion 348 of rod 305, terminating at two radial flowbores 505, 510. Radial flowbore 505 extends between axial flowbore 465 and an outer surface 472 of first base portion 348 of rod 30, where radial flowbore 505 terminates at a vent port 470. Hydraulic system 490 further includes a series of flowbores 515, 520, 525 530, 535 extending from radial flowbore 510 through first base portion 348 and second base portion 345 of rod 305, rear cover 360 of piston 310 and body 365 of piston 310 to an outer surface 540 of body 365. Hydraulic fluid is delivered between cavity 455 and outer surface 540 of body 365 adjacent inner surface 415 of sealing element 390 via flowbores 510, 515, 520, 525, 530, 535. Hydraulic system 490 further includes an inlet port 485 along an outer surface 480 of second base portion 345 of rod 305 and a series of flowbores 545, 550, 555, 560 extending from inlet port 485 through second base portion 345 of rod 305, rear cover 360 of piston 310 and body 365 of piston 310 to outer surface 540 of body 365. Hydraulic fluid is delivered from input port 485 to outer surface 540 of body 365 adjacent inner surface 415 of sealing element 390 via flowbores 545, 550, 555, 560.

To prevent loss of hydraulic fluid between cavity 455 and outer surface 540 of body 365, sealing members 518 are disposed between first base portion 348 and second base portion 345 around flowbore 520, between second base portion 345 and rear cover 360 around flowbore 520, and between rear cover 360 and body 365 around flowbore 530. Similarly, to prevent loss of hydraulic fluid between input port 485 and outer surface 540 of body 365, sealing members 518 are disposed between second base portion 345 and rear cover 360 around flowbore 545 and between rear cover 360 and body 365 around flowbore 555. To prevent loss of hydraulic fluid applied to inner surface 415 of sealing element 390, and instead allow that fluid to return to hydraulic system 490 via radial flowbore 535, sealing members 518 are also disposed between body 365 and rear cover 360, between body 365 and front cover 355, and between rear cover 365 and shoulder 350 of rod 305. In some embodiments, sealing members 518 are O-rings seated in annular grooves formed in second base portion 345 of rod 305, rear cover 360 of piston 310 and body 365 of piston 310.

An incompressible fluid, such as oil, is contained within hydraulic system 490. During assembly of piston rod assembly 300, hydraulic fluid is injected into hydraulic system 490 at input port 485. Any air that may be trapped in the hydraulic fluid is then bled off through vent port 470. If necessary, additional hydraulic fluid is injected into hydraulic system 490, and again, any air trapped in the hydraulic fluid is bled off. This process is repeated until hydraulic system 490 is completely fill and contains a solid column of hydraulic fluid. Input port 485 and vent port 470 are then closed. When necessary or desired, the hydraulic fluid may be drained from hydraulic system 490 through vent port 470.

A pressure transfer element 525 is disposed within cavity 455 of rod 305. Pressure transfer element 525 is a barrier between drilling fluid that enters axial flowbore 460 through inlet 435 and the incompressible fluid contained within hydraulic system 490. As such, the drilling fluid, which may contain abrasive particles or be otherwise incompatible with sealing element 390, is prevented by pressure transfer element 525 from mixing with or contaminating the fluid contained within hydraulic system 490. Thus, pressure transfer element 525 prevents exposure of sealing element 390 to the potentially abrasive or incompatible drilling fluid, such as mud.

Pressure transfer element 525 also transfers the pressure of drilling fluid contained in rod 305 to the fluid contained within hydraulic system 490, and vice versa, such that the fluid pressure on both sides of pressure transfer element 525 is substantially balanced. During operation of a pump including piston rod assembly 300, high pressure drilling fluid enters axial flowbore 460 of rod 305 through inlet 435 and exerts pressure on pressure transfer element 525, which, in turn, pressurizes fluid contained within hydraulic system 490. As the hydraulic fluid pressure increases, the hydraulic fluid pushes against inner surface 415 of sealing member 390 with increasing force. In response, sealing member 390 increasingly expands in the radially outward direction. Conversely, as the drilling fluid pressure decreases, the pressure exerted by this fluid on pressure transfer element 525, and in turn, on the hydraulic fluid also decreases. In response, the force exerted by the hydraulic fluid on inner surface 415 of sealing element 390 is reduced, allowing sealing element 390 to contract or relax.

In the embodiment shown in FIG. 2, pressure transfer element 525 is a diaphragm. Diaphragm 525 is a hollow, bell-shaped cup made of neoprene, or other suitable material, that collapses under pressure and expands again when the applied pressure is reduced or removed. Diaphragm 525 includes a generally cylindrical thin wall with an open end to receive hydraulic fluid in hydraulic system 490 and a closed end proximate axial flowbore 460. At the open end, the cylindrical wall is flanged. This flanged end is compressed between first base portion 348 and second base portion 345 of rod 305 to hold diaphragm 525 in place within cavity 455. The dimensions, e.g., length and/or internal volume, of diaphragm 525, measured at its natural state in the absence of any pressure exerted upon it by the hydraulic fluid or drilling fluid, are chosen such that when diaphragm 525 is fully collapsed, the pressure exerted on sealing member 390 by the hydraulic fluid is sufficient to maintain a seal between piston 310 and a surrounding pump cylinder under the full range of expected drilling fluid pressures.

During operation of piston rod assembly 300, drilling fluid enters the flowbore 460 of rod 305 and exerts pressure on diaphragm 525. Upon application of pressure from the drilling fluid, diaphragm 525 collapses, expelling hydraulic fluid contained within its cup-like shape, thereby pressurizing the fluid contained within hydraulic system 490. The hydraulic fluid then exerts pressure on inner surface 415 of sealing element 390, forcing sealing element 390 to displace in the radially outward direction. Conversely, as the drilling fluid pressure decreases, diaphragm 525 expands and again receives hydraulic fluid within its cup-like shape. In response, the pressure of fluid within hydraulic system 490 decreases, and sealing element 390 subsequently contracts or relaxes.

One of ordinary skill in the art will readily appreciate that the components of piston 310 may take other forms while still performing the same functions. For example, the position of cavity 455 may vary along the length of rod 305. Moreover, a rod extension may be coupled to end 550 of rod 305, and cavity 455 disposed within the rod extension. The locations and dimensions of the components forming hydraulic system 490 could then be modified to accommodate the new position of cavity 455. However, their function and the principles of operation of pressure compensated piston 310 would be as described above. Further, the general layout of hydraulic system 490 may be modified from that shown in FIG. 2, while still providing transfer of fluid pressure from the drilling fluid through pressure transfer element 525 and the hydraulic fluid to sealing element 390, and vice versa.

Figure 3:
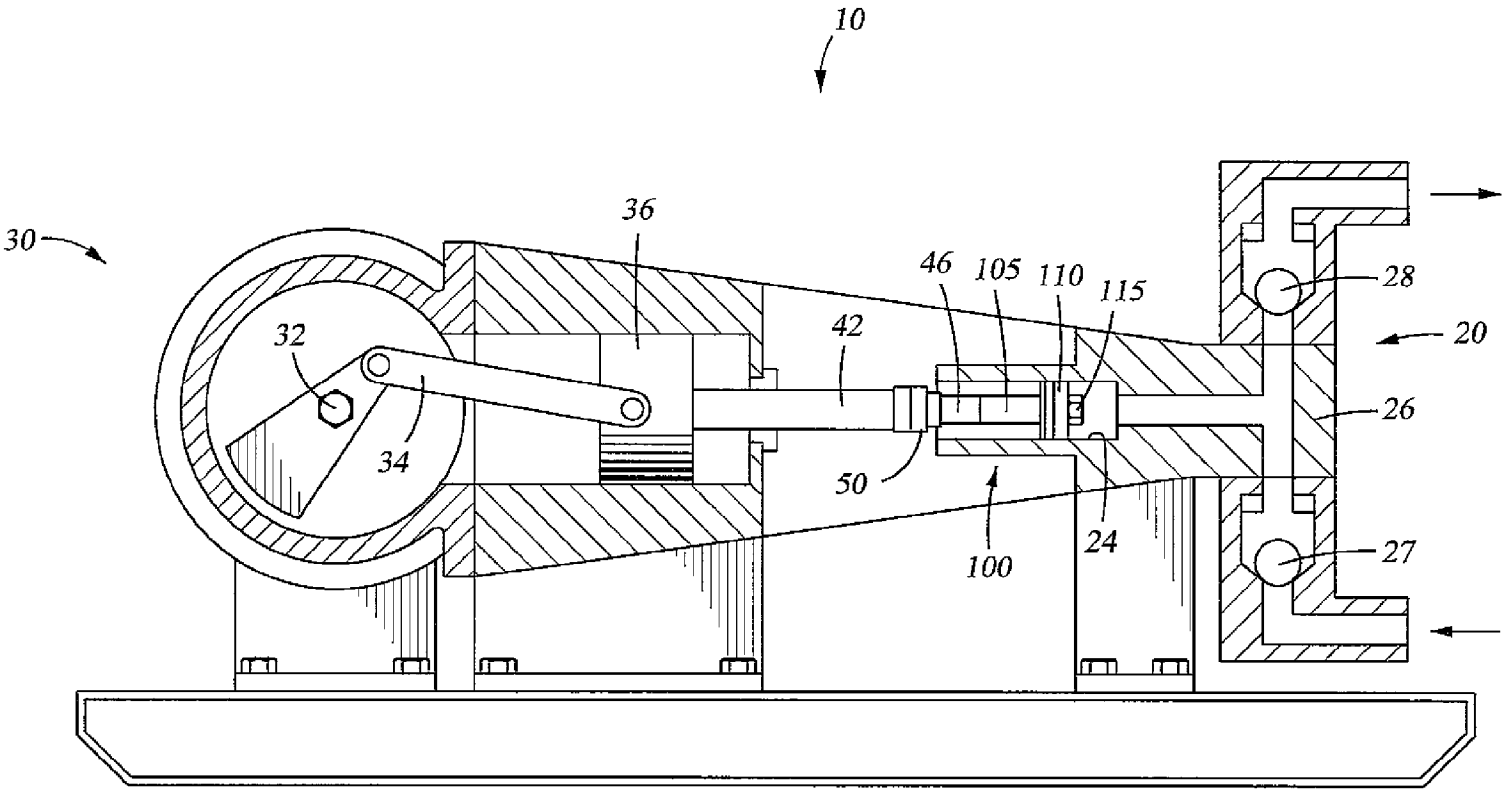
FIG. 3 is a cross-sectional view of a reciprocating pump comprising a pressure compensated piston rod assembly made in accordance with the principles described herein.

Embodiments of a pressure compensated piston rod assembly, including assembly 100 of FIG. 1 and assembly 300 of FIG. 2, find application in pumps, and in particular, reciprocating mud pumps used in connection with well drilling operations. Turning to FIG. 3, reciprocating mud pump 10 includes a fluid end 20 and a power end 30. Fluid end 20 includes a piston, which in this example is piston 110, shown in and described with reference to FIG. 1. Fluid end 20 further includes cylinder liner 24, module 26, intake valve 27 and outlet valve 28. Power end 30 includes a crankshaft 32, connecting rod 34 and crosshead 36. Fluid end 20 is coupled to power end 30 by an extension rod 42, rod sub 46 and rod 105, also shown in and described with reference to FIG. 1. Extension rod 42 connects to crosshead 36 and is coupled by clamp 50 to rod sub 46 and rod 105, which connects to piston 110. Although extension rod 42 is coupled to rod sub 46 by clamp 50 in this embodiment, these components may be coupled by other equivalent means, such as but not limited to a threaded connection. As previously described, rod 105 with piston 110 coupled thereto forms piston rod assembly 100. It will be understood that, instead of piston rod assembly 100, pump 10 may instead include piston rod assembly 300, shown in and described with reference to FIG. 2.

The design of piston 110, and in particular sealing element 190, is such that, after installation of piston rod assembly 100 within pump 10, there is radial interference between sealing element 190 (FIG. 1) of piston 110 and surrounding cylinder 24. In some embodiments, the diametrical interference of sealing member 190 with cylinder 24 after installation is 0.060 inches. This interference compresses sealing element 190, causing sealing element 190 to exert force against cylinder 24. The force exerted by sealing element 190 against cylinder 24 creates an initial seal between piston 110 and cylinder 24.

During operation, pump 10 draws drilling mud through intake valve 27 into module 26 where the drilling mud is pressurized by piston 110. Drilling fluid is then expelled at high pressure from pump 10 through outlet valve 28. During this pressurization process, piston rod assembly 100 is exposed to the pressurized drilling mud. Although the interference between sealing element 190 (FIG. 1) of piston 110 and cylinder 24 is sufficient to maintain the seal between these components when piston rod assembly 100 is exposed to low pressure drilling fluid, higher contact force between sealing element 190 and cylinder 24 is desired to maintain the seal when piston 110 is exposed to higher drilling fluid pressures.

To accommodate this goal, pressure compensated piston rod assembly 100 is configured to exert increasing force on cylinder 24 with increasing drilling fluid pressure. Thus, piston rod assembly 100 can maintain the seal between piston 110 and cylinder 24 as drilling fluid pressure increases. As previously described, during operation of pump 10, drilling fluid enters piston 110 through inlet 235 (FIG. 1) and flows through flowbores 220, 225, 227 until reaching inner surface 215 of sealing element 190, where the drilling fluid applies a pressure load to sealing element 190. In response to the applied pressure load, sealing element 190 expands in the radially outward direction and applies increased force to cylinder 24. The increased force exerted by piston 110 on cylinder 24 enables the seal between these components to be maintained. Moreover, as the drilling fluid pressure continues to increase, the pressure load exerted by the drilling fluid on sealing element 190, and, in turn, by sealing element 190 on cylinder 24 also continues to increase. In this manner, piston rod assembly 100 compensates for increasing drilling fluid pressure so as to maintain the seal between piston 110 and cylinder 24.

Conversely, when drilling fluid pressure decreases, the pressure load exerted by the drilling fluid on sealing element 190 decreases. In response, sealing element 190 contracts or relaxes, and the force exerted by sealing element 190 on cylinder 24 is reduced while still maintaining the seal between these components. Further, the friction load to piston 110 due to contact between sealing element 190 and cylinder 24 also decreases.

In this manner, pressure compensating piston rod assembly 100 applies to sealing element 190 only the minimum pressure needed to maintain the seal between piston 110 and cylinder 24, where the minimum pressure needed to maintain the seal depends on the drilling fluid pressure. Moreover, by adjusting the force exerted by piston 110 on cylinder 24 to only that required to maintain the seal, the frictional load created by contact between sealing element 190 and cylinder 24 is minimized. This results in increased pump efficiency and less wear to sealing element 190, thereby increasing the service life of piston 110.

By contrast, the frictional load between a sealing element and a cylinder in many conventional mud pumps is constant. That is the case because the force exerted by the sealing element against the surrounding cylinder does not vary, whether the pump experiences a minimum or maximum drilling fluid pressure. For this reason, the pump is designed to provide interference between the piston and surrounding cylinder such that the seal between the piston and the cylinder is maintained under the entire range of expected drilling fluid pressures. In other words, the interference is chosen based on worst case conditions. This means that when the pump is not operating under such worst case conditions, the interference is more than needed to maintain the seal. This creates an excessive frictional load between the sealing element and cylinder, causing unnecessary wear to the sealing element and reductions in pump efficiency.

While various embodiments have been shown and described, modifications thereof can be made by one skilled in the art without departing from the scope or teachings herein. The embodiments described herein are exemplary only and are not limiting. Many variations and modifications of the system and apparatus are possible. For example, the relative dimensions of various parts and the materials from which the various parts are made can be varied. Accordingly, the scope of protection is not limited to the embodiments specifically described herein, but is only limited by the claims that follow, the scope of which shall include all equivalents of the subject matter of the claims.

What is claimed is:

1. A pump comprising:

a piston having an axial throughbore, said piston comprising:

an annular body having a radially-facing outer surface, an axially-facing surface, an inlet port in the axially facing surface, and a flowpath extending between the inlet port and the radially-facing outer surface; and an annular sealing element disposed radially outward of the annular body, the sealing element having an inner surface adjacent the radially-facing outer surface of the body a first annular cover and a second annular cover disposed adjacent opposite ends of the annular body, each annular cover having an inner surface that receives and interlocks with an end surface of the sealing element.

2. The pump of claim 1, wherein the annular sealing element is a resilient member expandable in the radially outward direction upon application of a pressure load to the inner surface, and contractable upon reduction of the pressure load.

3. The pump of claim 1, wherein the body is mechanically coupled to the first and second covers.

4. The pump of claim 3, wherein the body is coupled to the first and second covers by one or more screws each inserted through a throughbore in one of the first cover and the second cover and threaded into a screwhole in the body.

5. The pump of claim 1, further comprising an annular sealing element between the body and the second cover, the sealing element configured to limit leakage of a fluid contained within the flowbore of the body.

6. The pump of claim 1, further comprising a rod extending through the axial throughbore of said piston.

7. The pump of claim 6, further comprising a retainer configured to couple said piston to said rod.

8. The pump of claim 1, wherein the flowpath comprises a first flowbore extending from the radially-facing outer surface and intersecting a second flowbore extending from the axially-facing outer surface.

9. A pump comprising:

a rod having a cavity disposed therein and an end;

a piston disposed about said rod, said piston comprising:

an annular body having a radially-facing outer surface;

an annular sealing element disposed about the annular body and having an inner surface adjacent the radially-facing outer surface;

a first fluid path between the end of said rod and the cavity;

a second fluid path between the cavity and the radially-facing outer surface of the annular body; and a resilient pressure transfer element disposed in the cavity and separating the first and the second flow paths.

10. The pump of claim 9, wherein said resilient pressure transfer element is configured to balance pressure of a fluid in the first fluid path with pressure of a fluid in the second fluid path.

11. The pump of claim 10, wherein said resilient pressure transfer element is collapsible upon application of a pressure load over an outer surface of said pressure transfer element, wherein said pressure transfer element pressurizes an incompressible fluid in said second fluid path, wherein the sealing element expands; and wherein said pressure transfer element is expandable upon reduction of the pressure load, wherein said pressure transfer element reduces the pressure of the incompressible fluid, wherein the sealing element contracts.

12. The pump of claim 11, wherein the incompressible fluid is oil.

13. The pump of claim 11, wherein said pressure transfer element is a cup-shaped diaphragm that is collapsible to expel fluid contained within and expandable to receive fluid therein.

14. The pump of claim 9, wherein the second fluid path is provided by one or more flowbores extending between the cavity and the radially-facing outer surface of the annular body.

15. The pump of claim 9, further comprising an inlet port for receiving fluid and an outlet port for removal of the fluid, wherein said inlet port and said outlet port are in fluid communication with said second fluid path.

16. The pump of claim 9, further comprising a first annular cover and a second annular cover disposed adjacent opposite ends of the annular body, each annular cover having an inner surface configured to receive and interlock with an end surface of the sealing element.

17. A pump comprising:

a piston cylinder;

a piston disposed within said piston cylinder and having an axial throughbore, the piston comprising:

a resilient annular sealing element having an inner surface and an outer surface adjacent said cylinder; and an annular body having a radially-facing outer surface adjacent the inner surface of the annular sealing element;

a rod inserted through the axial throughbore of said piston, wherein said rod comprises a cavity;

a fluid path in the annular body conveying pressurized fluid to the resilient annular sealing member;

a first fluid path between an end of the rod and the cavity;

a second fluid path between the cavity and the radially-facing outer surface of the annular body; and a resilient pressure transfer element disposed in the cavity and separating the first and the second flow paths.

18. The pump of claim 17, wherein said resilient pressure transfer element is collapsible upon application of a pressure load over an outer surface of said pressure transfer element, wherein said pressure transfer element pressurizes an incompressible fluid in said second fluid path, wherein the sealing element expands; and wherein said pressure transfer element is expandable upon reduction of the pressure load, wherein said pressure transfer element reduces the pressure of the incompressible fluid, wherein the sealing element contracts.

19. The pump of claim 18, wherein said pressure transfer element is a cup-shaped diaphragm that is collapsible to expel fluid contained within and expandable to receive fluid therein.

20. The pump of claim 17, further comprising an inlet port for receiving incompressible fluid and an outlet port for removal of the incompressible fluid, wherein said inlet port and said outlet port are in fluid communication with said second fluid path.

21. The pump of claim 17, further comprising a first annular cover and a second annular cover disposed adjacent opposite ends of the annular body, each annular cover having an inner surface configured to receive and interlock with an end surface of the sealing element.

* * * * *